US007575125B2

(12) United States Patent
Bagley, Jr.

(10) Patent No.: US 7,575,125 B2
(45) Date of Patent: Aug. 18, 2009

(54) TRAY FOR EXCHANGING ITEMS

(76) Inventor: Lonnie Bagley, Jr., 107 Pioneer St., Gadsden, AL (US) 35903

( * ) Notice: Subject to any disclaimer, the term of this patent is extended or adjusted under 35 U.S.C. 154(b) by 546 days.

(21) Appl. No.: 11/224,478

(22) Filed: Sep. 12, 2005

(65) Prior Publication Data

US 2007/0056973 A1 Mar. 15, 2007

(51) Int. Cl.
*B65D 25/22* (2006.01)
*B65D 25/24* (2006.01)
*B65D 25/10* (2006.01)

(52) U.S. Cl. ..... 220/475; 220/478; 220/752

(58) Field of Classification Search ..... 220/475, 220/478, 752, 761, 762, 764, 23.86; 206/541, 206/549

See application file for complete search history.

(56) References Cited

U.S. PATENT DOCUMENTS 3,457,852 A * 7/1969 Kwoh ..... 99/340
3,981,044 A 9/1976 Luebke et al.
D296,643 S 7/1988 Mueller
D301,600 S 6/1989 Wilson
4,927,046 A 5/1990 Armstrong
D359,832 S 6/1995 Woolrich
5,445,425 A 8/1995 Lyver
5,799,997 A 9/1998 Lehn et al.
6,419,541 B1 7/2002 Apichom
6,520,473 B2 * 2/2003 Lee ..... 248/352
6,732,636 B1 5/2004 Germano
7,309,106 B2 * 12/2007 Stallman ..... 297/310

* cited by examiner

*Primary Examiner*—Anthony D Stashick
*Assistant Examiner*—Shawn M Braden
(74) *Attorney, Agent, or Firm*—Dale J. Ream

(57) ABSTRACT

A tray for exchanging items includes a receptacle defining a plurality of compartments including food, drink, and coinage compartments. An awning is mounted to the receptacle for covering the receptacle from weather events. A guide is mounted to the receptacle and extends upwardly to an upper portion of the awning. An extensible handle is pivotally coupled to the guide for selective movement between generally horizontal and vertical configurations. The handle supports the receptacle for loading in the vertical configuration and enables the receptacle to be extended to a consumer in a vehicle at a drive-through restaurant in the horizontal configuration. A lower portion of the guide is a completely open channel through which the handle may move between horizontal and vertical configurations.

12 Claims, 6 Drawing Sheets

TRAY FOR EXCHANGING ITEMS

BACKGROUND OF THE INVENTION

This invention relates generally to a portable tray and, more particularly, to a tray for exchanging items such as food, payment, and change.

Exchanging food, payment, and change—especially coinage—is often a difficult and frustrating task experienced frequently in the fast food industry. Difficulty in making a smooth delivery of these items is especially experienced if the driver of an automobile navigates too far from the delivery window, if either the delivery attendant or driver have short arms, or if too many items are passed too quickly. Worst case scenarios, such as dropped money or food, occur too frequently.

Various devices have been proposed in the art for collecting items from a distance. Specifically, U.S. Pat. No. 6,419,541 to Apichom discloses a bag with a handle for collecting Halloween candy. This patent is directed to a mechanism for rapid extension to startle the one offering a treat. Other patents are directed to cookware having handles for user convenience. Although assumably effective for their intended purposes, the prior proposals do not provide a variably extendable tray adapted for the exchange of fast food and payment.

SUMMARY OF THE INVENTION

A tray for the exchange of items according to the present invention includes a receptacle defining multiple compartments configured to hold food items, coinage, etc. The receptacle includes a guide to which an elongate handle is pivotally coupled and movable between first and second configurations. In a first vertical configuration, the handle is useful as a support member while the receptacle is being loaded with food or a customer's change. In a second generally horizontal configuration, the handle is useful to extend the receptacle to a customer's vehicle window, e.g. at a drive-through fast food restaurant, for convenient exchange of food or payment. Preferably, the handle includes an extensible construction. The receptacle may also include an awning for shielding the receptacle's contents from weather elements.

Therefore, a general object of this invention is to provide a tray for exchanging items between individuals separated from one another by more than a convenient arms length.

Another object of this invention is to provide a tray, as aforesaid, having a receptacle defining multiple compartments for securely and removably holding food, drinks, and money.

Still another object of this invention is to provide a tray, as aforesaid, that is compact for ease of storage and loading.

Yet another object of this invention is to provide a tray, as aforesaid, that is user-friendly, easy to maintain, and keep clean.

A further object of this invention is to provide a tray, as aforesaid, that is inexpensive to manufacture.

A still further object of this invention is to provide a tray, as aforesaid, that is convenient to store when not in use.

Other object and advantages of the present invention will become apparent from the following description taken in connection with the accompanying drawings, wherein is set forth by way of illustration and example, an embodiment of this invention.

DESCRIPTION OF THE PREFERRED EMBODIMENT

Figure 1:
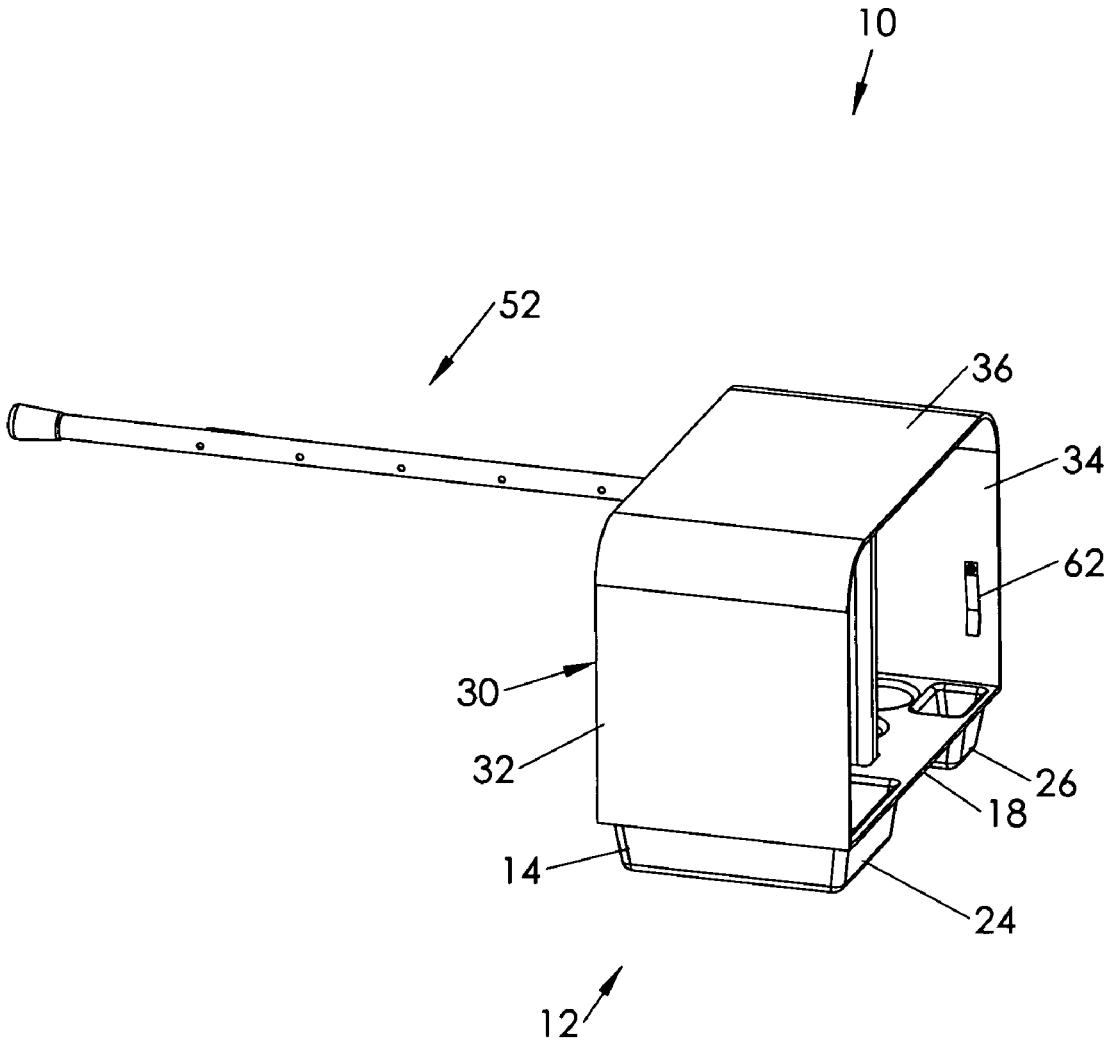
FIG. 1 is a rear perspective view of a tray according to the present invention with a telescopic handle in a horizontal configuration.
Figure 2:
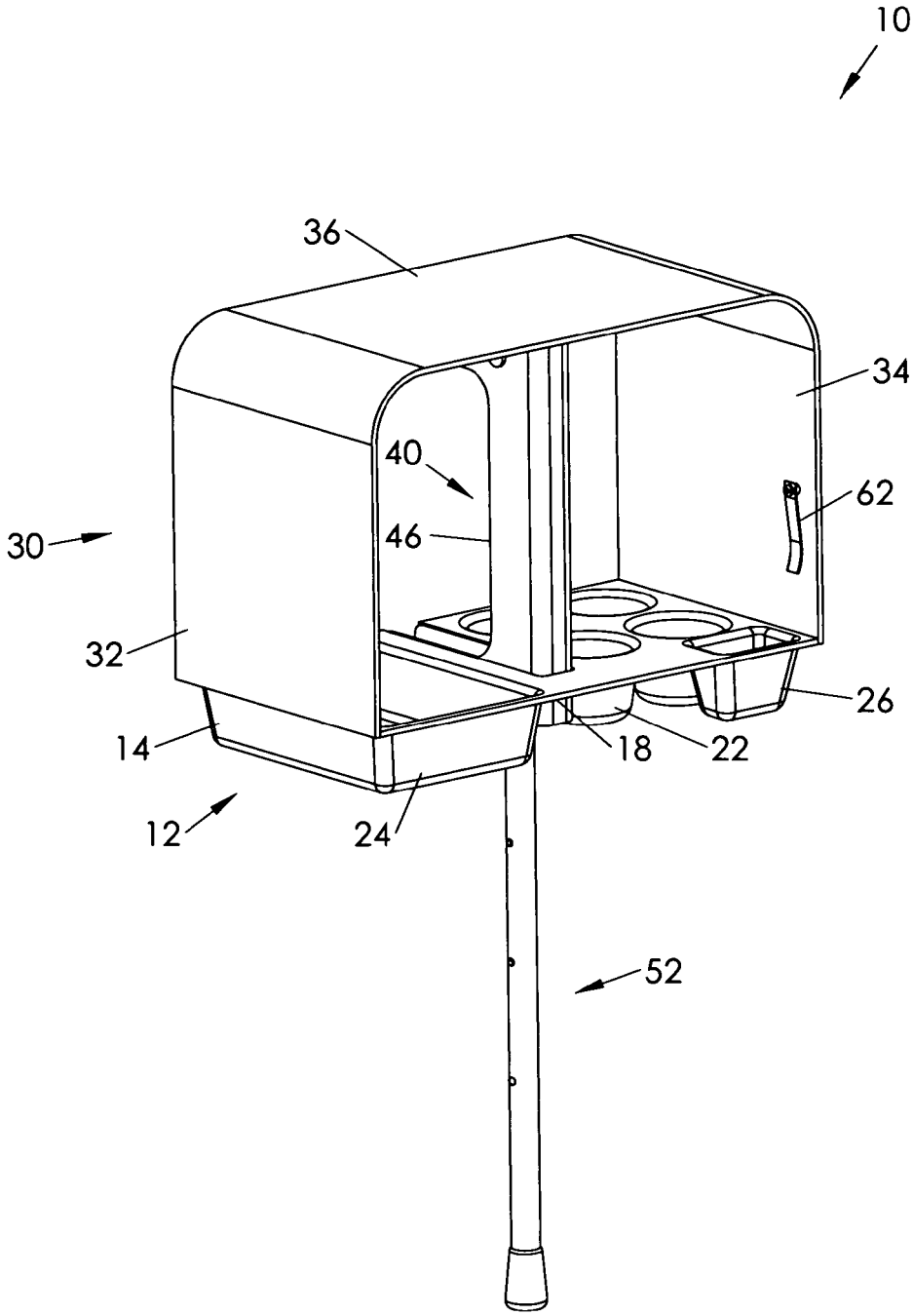
FIG. 2 is another perspective view of the tray as in FIG. 1 with the telescopic handle in a vertical configuration.

A tray for exchanging items according to the present invention will now be described in detail with reference to FIGS. 1 through 6*b* of the accompanying drawings. More particularly, the present invention is a tray 10 for exchanging items between two users who are separated by a distance that is more than a convenient arm's length, e.g. a customer and a cashier such as at a fast food restaurant drive through window. The tray 10 includes a receptacle 12 having left 14 and right 16 sides and defining multiple compartments, such as one or more drink compartments 22, a larger food compartment 24, and a coin compartment 26 (FIG. 2). Each of these compartments include side walls extending downwardly from a top surface of the receptacle 12 and include open tops and closed bottom walls for capturing appropriate articles therein, although it is understood that the drink receptacles may not have bottom walls so long as their top openings are configured to securely capture a drink container and not allow it to fall through.

Preferably, the receptacle 12 includes an awning 30 having left 32 and right 34 portions extending upwardly from left 14 and right 16 sides of the receptacle top surface, respectively, and having a top portion 36 spanning between the left 32 and right 34 portions. The awning 30 provides protection of food or payment from weather elements when in use.

Figure 4:
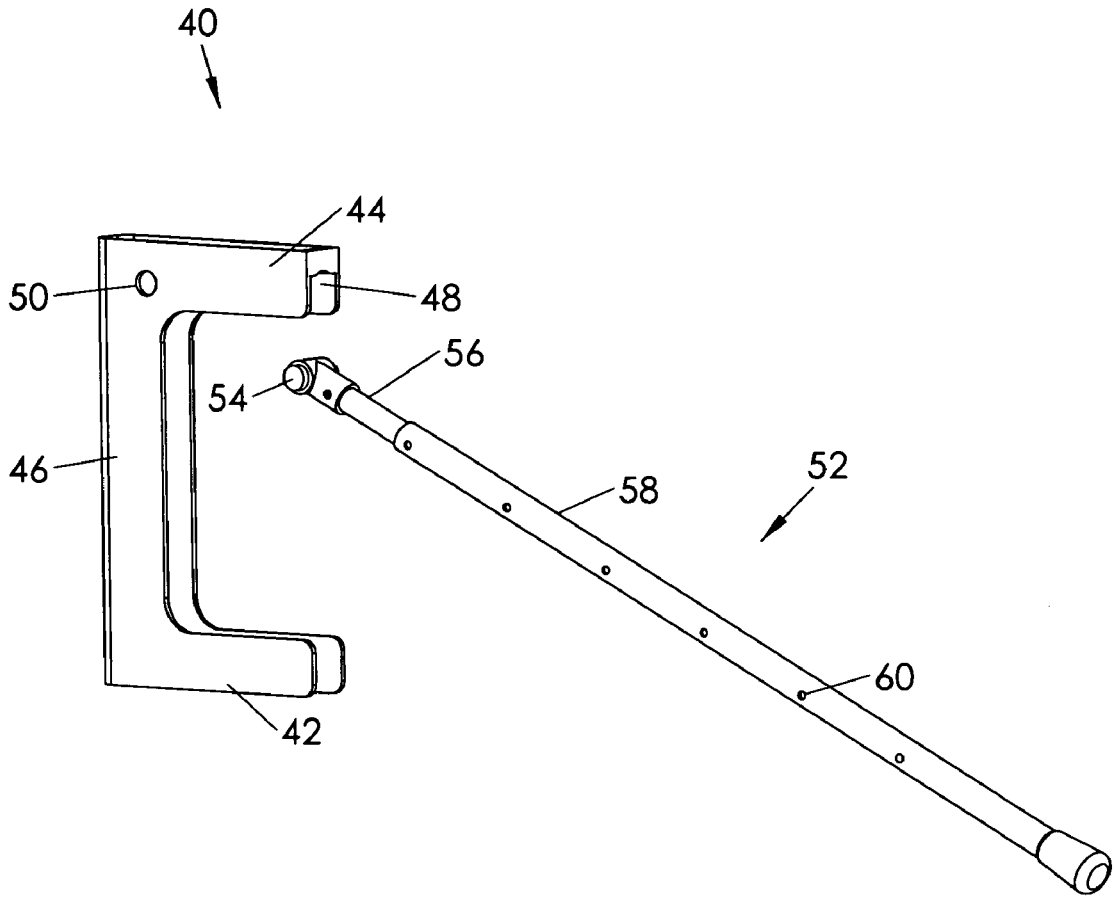
FIG. 4 is a perspective view of the guide and handle removed from the tray and with the handle removed from attachment to the guide.
Figure 5A:
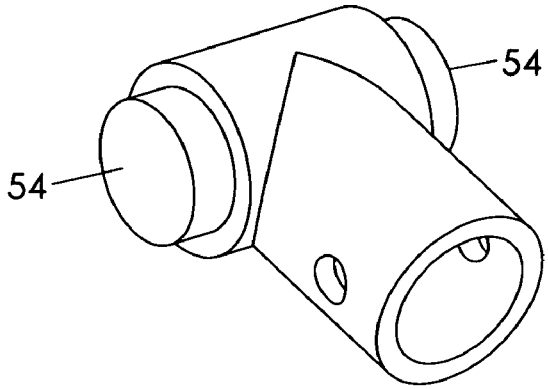
FIG. 5*a* is a perspective view of a handle button in an extended configuration.
Figure 5B:
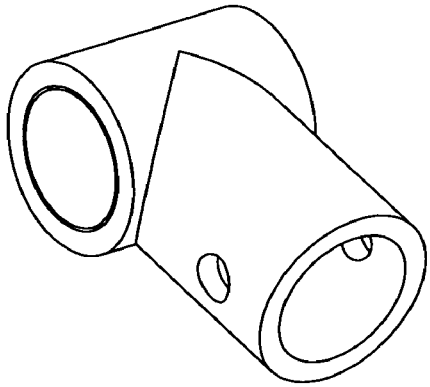
FIG. 5*b* is a perspective view of the handle button as in FIG. 5*a* in a depressed configuration.
Figure 6A:
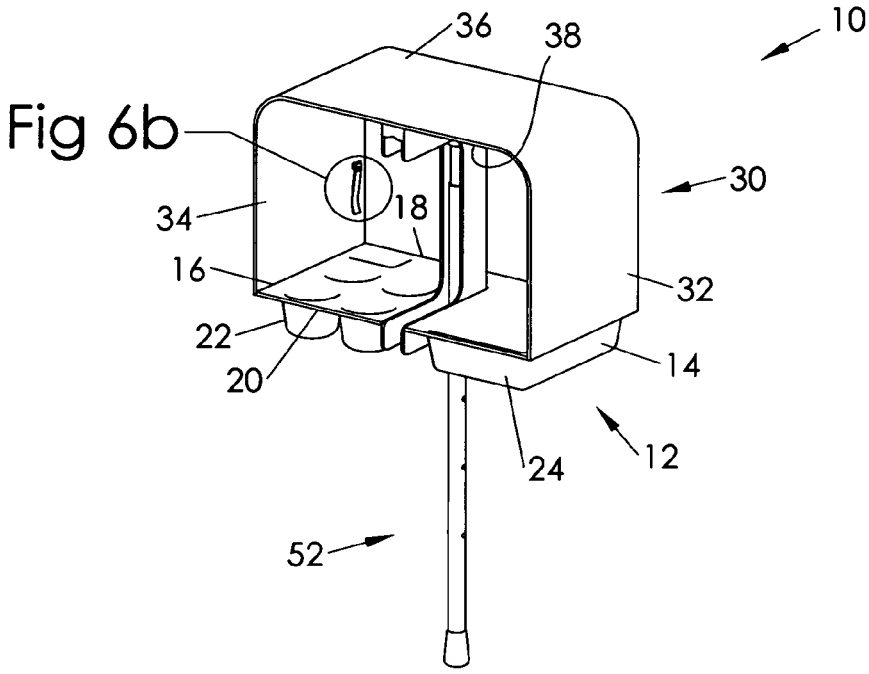
FIG. 6*a* is a front perspective view of the tray as in FIG. 1 with the handle in a vertical configuration.

The receptacle 12 includes a guide 40 having a generally C-shaped configuration (FIG. 4). The guide includes generally horizontal lower 42 and upper 44 portions and a generally upright portion 46 extending therebetween, each of which is open toward the interior. The lower portion 42 is also open on to the exterior (i.e. its lower extent) so as to enable a handle to swing therethrough as will be further described below. The receptacle 12 defines an opening 28 extending from a rear edge 20 thereof and extending substantially toward a front edge 18 thereof (FIG. 6*a*). The guide 40 is mounted to the receptacle 12 such that its lower portion 42 fills the receptacle opening 28. The upper portion 44 of the guide 40 is attached to an inner surface 38 of the awning 30. The upper portion 44 of the guide 40 defines a wall mount receiver 48 so that the tray 10 may be conveniently stowed upon a wall when not in use (FIGS. 4 and 6*a*). It is understood that the guide 40 could alternatively be removable for cleaning purposes (not shown). Preferably, the guide 40 is centered between sides of the receptacle 12.

Figure 3:
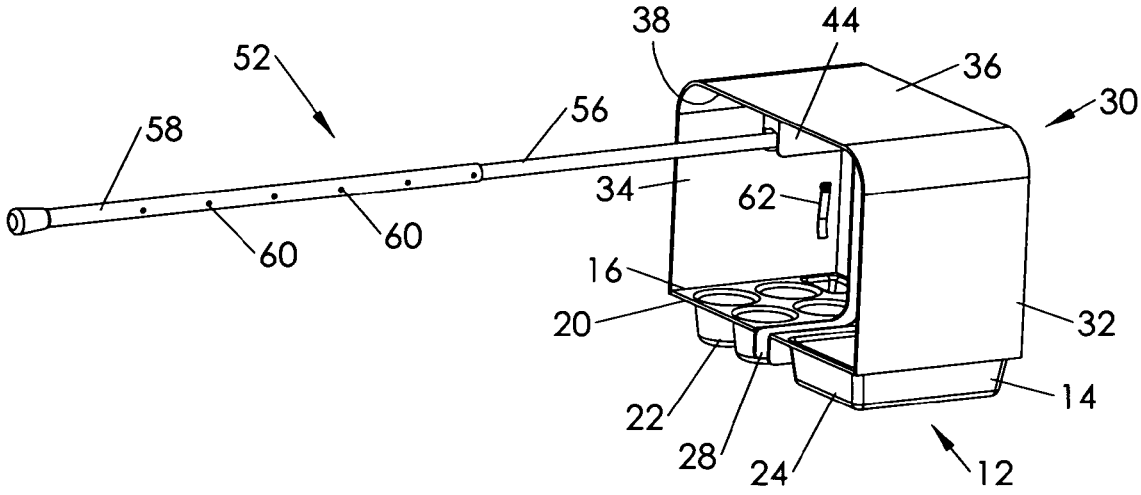
FIG. 3 is a front perspective view of the tray as in FIG. 1 with the telescopic handle in an extended configuration.

The tray 10 includes an elongate handle 52 that may be pivotally and removably coupled to the guide 40. More particularly, the upper portion 44 of the guide 40 defines an attachment hole 50 (FIG. 4). The handle 52 includes a button 54 at a first end thereof having a configuration complementary to the attachment hole 50 for releasably connecting the handle 52 to the guide 40. Preferably, the button 54 is spring biased in an extended configuration for securely holding the handle 52 in the attachment hole 50. A user, therefore, may push the button 54 and move the handle 52 between first and second configurations. The first configuration is a generally vertical stowage or support position (FIGS. 2 and 6*a*) in which the handle 52 nests in the guide upright portion 46 and the second configuration is a generally horizontal use position in which the handle generally nests in the channel of the guide upper portion 44 (FIGS. 1 and 3).

The handle 52 includes an extensible construction. More particularly, the handle 52 includes a first portion 56 in telescopic communication with a second portion 58 for selective extension of the first portion 56 relative to the second portion 58. The second portion 58 presents a diameter larger than a diameter of the first portion 56 for relative movement of the first portion 56 in the second portion 58. The second portion 58 further defines a plurality of a plurality of holes 60 longitudinally spaced apart therealong. The first portion 56 includes a spring-loaded pin biased toward an extended configuration for selective communication with a respective hole 60.

Alternatively, the extensible handle 52 may include a construction having complementary threads (not shown). More particularly, each portion may include first and second ends. Then, the first and second portions may include complementary interior and external threads for relative movement between retracted and extended configurations. Yet another method for a telescopic handle would be a cam-lock design.

Figure 6B:
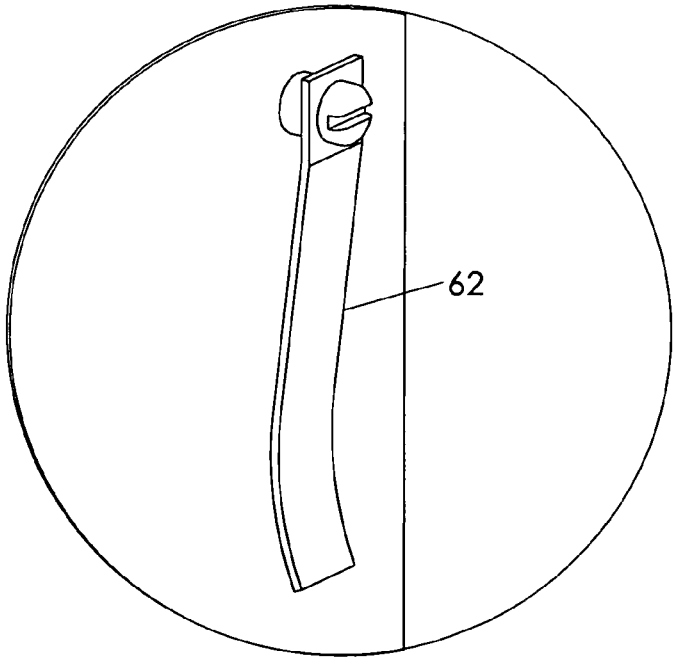
FIG. 6*b* is a perspective view on an enlarged scale of a money clip shown in FIG. 6*a*.

A clip 62 is mounted to either the left 32 or right 34 portion of the awning 30 for holding currency from a customer or being given as change by a clerk (FIGS. 6*a* and 6*b*). Preferably, the clip 62 is constructed of spring steel although plastic would also be suitable. Preferably, the clip 62 includes a first end attached to an inner surface of an awning side portion and a second opposed end adjacent the inner surface. It is understood that the second is biased toward the inner surface but may be lifted slightly to insert or remove currency thereunder.

In use, the tray 10 may be used to exchange food and payment between a consumer in a vehicle and a clerk at a drive through type restaurant. More particularly, the handle 52 may be pivoted to a second/horizontal configuration and extended from a drive through window toward a customer's vehicle whereby payment for an ordered meal may be placed in the money clip 62 and/or coin compartment 26. The tray 10 may then be withdrawn back into the window. The handle 52 may be pivoted to the first/vertical configuration for supporting the receptacle 12 while the tray 10 is loaded with food, drink, and change. Then, the handle 52 may again be pivoted to the horizontal configuration for extending the receptacle 12 to the customer. When the tray 10 is no longer needed, the handle 52 may be again moved to the vertical configuration and the tray 10 may be stowed by engaging the wall mount receiver 48 to a wall fastener.

It is understood that while certain forms of this invention have been illustrated and described, it is not limited thereto except insofar as such limitations are included in the following claims and allowable functional equivalents thereof.

What is claimed is as follows:

1. A tray for exchanging items, said tray comprising:

a receptacle defining a plurality of compartments and having opposed left and right sides, said receptacle defining an interior space;

a C-shaped guide attached to said receptacle and positioned in said interior space adjacent said receptacles and extending upwardly therefrom, said guide being centered between said left and right sides of said receptacle;

an elongate handle pivotally attached to said guide and pivotally movable between a first generally vertical configuration and a second generally horizontal configuration;

wherein:

said guide includes a generally upright portion, a generally horizontal upper portion, and a generally horizontal lower portion;

said guide upright portion defines a generally vertical channel for selectively receiving said handle when said handle is at said first configuration;

said guide horizontal upper portion defines a generally horizontal channel for selectively receiving said handle when said handle is at said second configuration;

said upright portion, said horizontal upper portion, and said horizontal lower portion are open toward an interior of said receptacle;

said horizontal lower portion are open to an exterior of said receptacle to receive said handle therethrough when said handle is at said first configuration;

an awning extending upwardly from said receptacle for covering said receptacle, said awning having a left portion extending upwardly from said receptacle left side, a right portion extending upwardly from said receptacle right side, and a top portion spanning and being fixedly attached to said awning left and right portions, said awning defining an open front and an open back;

wherein:

said elongate handle is pivotally attached to said guide horizontal upper portion;

said guide horizontal upper portion defines an attachment hole;

said handle includes first and second ends; and a button extends from said handle first end and includes a configuration complementary to a configuration of said attachment hole for releasably connecting said handle to said attachment hole said button including a spring for biasing said button to an extended configuration for securely connecting said handle to said attachment hole.

2. The tray as in claim 1, wherein an upper surface of said guide horizontal portion is attached to an inner surface of said awning.

3. The tray as in claim 1, wherein said receptacle defines an elongate opening having a configuration complementary to a configuration of said handle for allowing said handle to rotate through said elongate opening when moving between said first and second configurations.

4. The tray as in claim 3, wherein said elongate opening extends from a rear edge of said receptacle toward a front edge of said receptacle.

5. The tray as in claim 4, wherein said handle includes a first portion in telescopic communication with a second portion for selective extension of said first portion relative to said second portion.

6. The tray as in claim 4, wherein said elongate opening is centered between said left and right receptacle sides.

7. The tray as in claim 1, wherein said handle includes a first portion in telescopic communication with a second portion for selective extension of said first portion relative to said second portion.

8. The tray as in claim 7, wherein:

said handle second portion has an interior diameter that is larger than an exterior diameter of said handle first portion;

a pin is attached to said handle first portion;

a spring is in communication with said pin and said handle first portion for biasing said pin away from said handle first portion;

said handle second portion defines a plurality of holes; and each handle second portion hole has a configuration complementary to a configuration of said pin for selectively receiving said pin.

9. The tray as in claim 7, wherein:

said handle first portion presents opposed first and second ends;

said handle second portion presents opposed first and second ends;

said handle first portion defines a plurality of holes extending from said handle first portion second end toward said handle first portion first end;

said handle first portion defines external threads extending from said handle first portion second end toward said handle first portion first end;

said handle second portion defines internal threads extending from said handle second portion first end toward said handle second portion second end;

said internal threads have a configuration complementary to a configuration of said external threads; and said handle first portion has an exterior diameter that is larger than an interior diameter of said handle second portion, whereby mating said internal and external threads causes said handle first portion slots to contract.

10. The tray as in claim 1, further comprising a clip attached to an inner surface of said awning, wherein:

said clip includes first and second ends;

said clip first end is attached to said awning inner surface;

said clip second end selectively abuts said awning inner surface; and said clip second end is biased toward said awning inner surface.

11. The tray as in claim 1, wherein said upper portion of said guide defines a fastener for selectively stowing said receptacle upon a wall.

12. The tray as in claim 1, wherein:

a respective receptacle compartment is a drink compartment;

a respective receptacle compartment is a food compartment; and a respective receptacle compartment is a coin compartment.

* * * * *